United States Patent [19]

Wakase

[11] Patent Number: 4,710,147

[45] Date of Patent: Dec. 1, 1987

[54] FOUR-WHEEL DRIVE UNIT FOR TOY VEHICLE

[75] Inventor: Hiroshi Wakase, Tokyo, Japan

[73] Assignee: Takara Co., Ltd., Tokyo, Japan

[21] Appl. No.: 880,724

[22] Filed: Jul. 1, 1986

[30] Foreign Application Priority Data

Jul. 2, 1985 [JP] Japan ..... 60-100780[U]

[51] Int. Cl.[4] ..... A63H 29/00; A63H 17/26

[52] U.S. Cl. ..... 446/464; 446/466; 446/469

[58] Field of Search ..... 446/464, 466, 469, 462

[56] References Cited

U.S. PATENT DOCUMENTS

| | | | |
|---|---|---|---|
| 2,096,333 | 10/1937 | Marx | 446/464 X |
| 2,216,497 | 10/1940 | McHenry | 446/466 |
| 4,443,968 | 4/1984 | Law | 446/462 |
| 4,459,776 | 7/1984 | Jaworski et al. | 446/462 |
| 4,463,831 | 8/1984 | Wakase | 446/464 X |
| 4,509,931 | 4/1985 | Lambert et al. | 446/469 X |
| 4,540,376 | 9/1985 | Turbowitz et al. | 446/462 X |
| 4,565,538 | 1/1986 | Kennedy et al. | 446/462 X |

*Primary Examiner*—Philip C. Kannan
*Attorney, Agent, or Firm*—Price, Gess & Ubell

[57] ABSTRACT

A four-wheel drive unit for a toy vehicle, comprising a windup spring drive mechanism including a first axle, a gear mechanism having a second axle and a link shaft which rotatably connects the first axle to the second axle via link gears so that the gear mechanism may pivot around the axis of the link shaft with reference to the drive mechanism, and the first and the second axles may be rotated in the same direction.

11 Claims, 4 Drawing Figures

FOUR-WHEEL DRIVE UNIT FOR TOY VEHICLE

BACKGROUND OF THE INVENTION

The present invention relates to a four-wheel drive unit for a toy vehicle and, more particularly, to a windup spring four-wheel drive unit for a toy vehicle, which is capable of always properly transmitting a drive force from front and rear wheels to the ground even when the front and the rear axles are twisted in their axial direction.

A variety of interesting conventional four-wheel drive toy vehicles such as a toy automobile have been heretofore developed. Such four-wheel drive toy vehicles may be run on a rough road or an off road in the same manner as a real four-wheel drive vehicle. These toy vehicles are full of interest and bring much enjoyment to their users.

In the conventional four-wheel drive toy vehicles, although a four-wheel drive mechanism together with a proper suspension mechanism similar to those of the actual four-wheel drive vehicle can be employed in a large-sized toy vehicle, in a small-sized toy vehicle such as a so-called mini toy vehicle, such complicated mechanisms can not be used and the front and the rear axles are rotatably fixed to a chassis of the toy vehicle. Accordingly, in this case, the four wheels are always positioned in a flat plane regardless of how rough the surface of a road is. Hence, when the front wheel axle is twisted with reference to the rear wheel axle by so-called rolling, the drive force cannot be properly transmitted from the four wheels to the ground.

SUMMARY OF THE INVENTION

Accordingly, it is an object of the present invention to provide a four-wheel drive unit for a toy vehicle, free from the aforementioned defects and disadvantages of the prior art, which is capable of always properly transmitting a drive force from the front and rear wheels to the ground when the front wheel axle is twisted with reference to the rear wheel axle by rolling. Such a toy vehicle will be both exciting to race on a rough road and lots of fun.

It is another object of the present invention to provide a four-wheel drive unit for a toy vehicle, in which the front and rear wheels are driven by a windup spring drive mechanism and a gear mechanism; such a four-wheel drive unit is compact and simple and detachably mounted to a toy vehicle by a simple operation. A variety of interesting combinations of this drive mechanism and gear mechanism may also be employed.

In accordance with one aspect of the invention, there is provided a four-wheel drive unit for a toy vehicle, comprising (a) a windup spring drive mechanism which comprises a first casing, a windup spring arranged in the first casing, a first axle rotatably mounted to the first casing, to which a pair of wheels are to be secured, a plurality of gear wheels rotatably arranged in the first casing, through which the drive force of the windup spring is transmitted to the first axle, and a first link gear secured to the first axle, (b) a gear mechanism which comprises a second casing, a second axle rotatably mounted to the second casing, to which another pair of wheels are to be secured, and a second link gear secured to the second axle, and (c) a link shaft having a pair of third and fourth link gears in its opposite ends, which is rotatably mounted to the first and the second casing and connects the first axle to the second axle through the first, the second, the third and the fourth link gears so that the first and the second axles may be arranged substantially in parallel, wherein the first and the second link gears are engaged with the third and the fourth link gears, respectively, so that the first and the second axles may be rotated in the same direction. In a preferred embodiment of the invention, the first and the second gears are crown gears and the third and the fourth gears are pinion gears.

In another preferred embodiment of the invention, either the first or the second casings is provided with a tubular projection for supporting the link shaft, in which the link shaft is fitted rotatably and coaxially, and either the first or the second casings is provided with a hole coaxially with the link shaft, in which the tubular projection is fitted rotatably and coaxially.

Other and further objects, features and advantages of the invention will appear more fully from the following description taken in connection with the preferred embodiment thereof with reference to the accompanying drawings, in which:

DESCRIPTION OF THE PREFERRED EMBODIMENT

Figure 1:
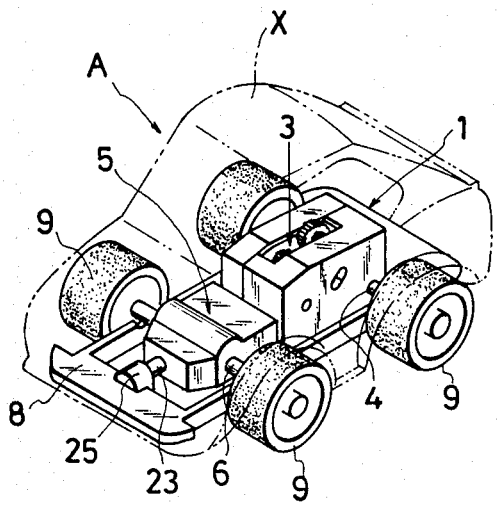
FIG. 1 is a perspective view of a four-wheel drive unit for a toy vehicle according to the present invention, which is mounted to a chassis of a toy vehicle.

Referring now to the drawings, wherein like reference numerals designate similar or corresponding components throughout the different Figures and hence a description of the structure and function of such like components can be omitted for the sake of brevity, there is shown in FIGS. 1–4 a four-wheel drive unit for a toy vehicle according to the present invention.

In the drawings, a windup spring drive mechanism 1 includes a casing 1*a*, a windup spring 2 disposed in the casing 1*a*, a gear wheel means 3 arranged in the casing 1*a* and a first axle or a rear wheel axle 4 extending sideways through the casing 1*a*, that is, sideways through a chassis 8. A gear mechanism 5 comprises a casing 5*a*, a second axle or a front wheel axle 6 parallel with the rear wheel axle 4. To the rear and the front wheel axles 4 and 6, pairs of rear and front wheels 9 are secured, respectively. The drive mechanism 1 and the gear mechanism 5 are independently mounted to the chassis 8.

The windup spring 2 is secured to a shaft 2*a* along with a large gear wheel 10 and a small gear wheel 11. The windup spring 2 is wound up by rotating the shaft 2*a* so as to store up a drive force, and, when the shaft 2*a* is released, the spring 2 is loosened quickly so as to release the drive force. The gear wheel means 3 comprises the large and the small gear wheels 10 and 11, a plurality of intermediate gear wheels 12–16 and a loose gear wheel 17 and transmits the drive force of the spring 2 to the rear wheel axle 4.

A drive gear wheel 18 is secured to the rear wheel axle 4 and engages the last intermediate gear wheel 16.

A crown gear 19 is also secured to the rear wheel axle 4.

Figure 4:
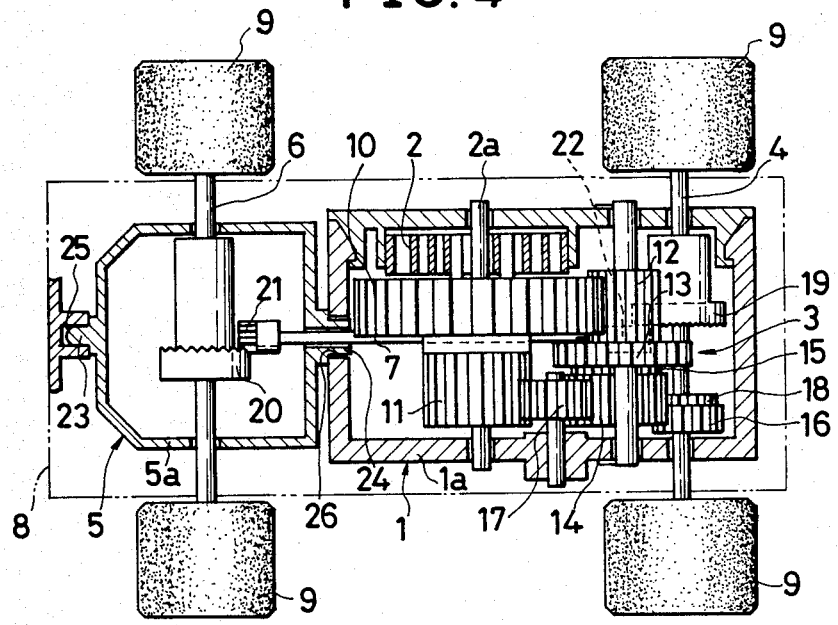
FIG. 4 is a top plan view of FIG. 3, partly in section.

A crown gear 20 is secured to the front wheel axle 6 of the gear mechanism 5. The crown gears 19 and 20 are arranged facing each other so that the front and the rear wheel axles 6 and 4 may be rotated in the same direction, as hereinafter described in detail, and as shown in FIG. 4.

A link shaft 7 to which a pair of pinion gears 21 and 22 are secured in its opposite ends, is horizontally extended through the casings 1*a* and 5*a* of the drive mechanism 1 and the gear mechanism 5 at the same height as the rear and the front wheel axles 4 and 6, and the front and the rear pinion gears 21 and 22 are engaged with the front and the rear crown gears 20 and 19, respectively, while the rear and the front crown gears 19 and 20 are positioned on the opposite sides of the link shaft 7.

The gear mechanism 5 is provided with a pivoting projection 23 and a tubular projection 24 in the front and the rear end walls of its casing 5*a* and these projections 23 and 24 are arranged coaxially with the axis of the link shaft 7. The link shaft 7 is inserted in the tubular projection 24 so as to support the link shaft 7. Further, a tubular support hole 25 is provided in the central portion of the front end of the chassis 8 and the pivoting projection 23 of the gear mechanism 5 is fitted in the support hole 25 of the chassis 8. A support hole 26 is formed in the central portion of the front end wall of the casing 1*a* of the drive mechanism 1 and the tubular projection 24 of the gear mechanism 5 is fitted in the support hole 26 of the drive mechanism 1.

Accordingly, the gear mechanism 5 or the front wheel axle 6 is pivoted around its projections 23 and 24, that is, the link shaft 7, while the projections 23 and 24 are supported by the chassis 8 and the casing 1*a* of the drive mechanism 1 at their support holes 25 and 26.

In accordance with the present invention, in its turn, support holes may be provided in the gear mechanism 5 instead of the projections 23 and 24 and the projections may be formed in the chassis 8 and the casing 1*a* of the drive mechanism instead of the support holes 25 and 26 in the reverse manner to the above described embodiment.

Further, since the drive mechanism 1 and the gear mechanism 5 are rotatably connected through the link shaft 7, the projections 23 and 24 and the support holes 25 and 26 may be omitted, as occasion demands.

The four-wheel drive unit described above is fixed to a toy vehicle A as follows. The rear axle drive mechanism 1 is mounted to the rear part of the chassis 8 by means of engaging members (not shown) of the chassis 8, and the front axle gear mechanism 5 is pivotally mounted to the front part of the chassis 8. Then, a body X is mounted onto the chassis 8 to cover it, thereby resulting in the four-wheel drive toy vehicle A.

Then, when the toy vehicle A is slid rearwards while at least its rear wheels 9 are contacted with the ground, the windup spring 2 is wound up so as to store up the drive force. Then, when the toy vehicle A is released on a running surface, the windup spring 2 is loosened and the toy vehicle A starts to rush frontwards due to the drive force of the spring 2 and the rotation of four wheels 9.

Figure 2:
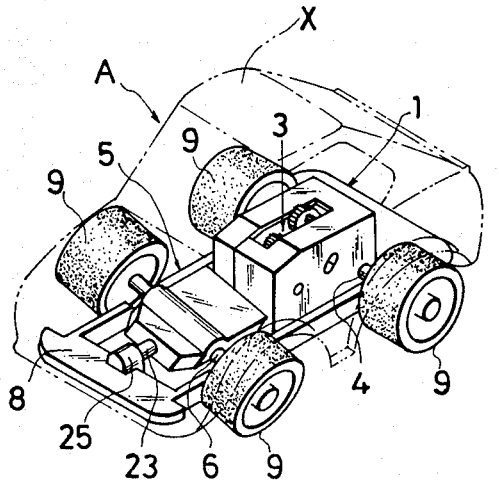
FIG. 2 is a similar perspective view of the drive unit of FIG. 1, in which a front wheel axle is twisted in its axial direction reference to a rear wheel axle.
Figure 3:
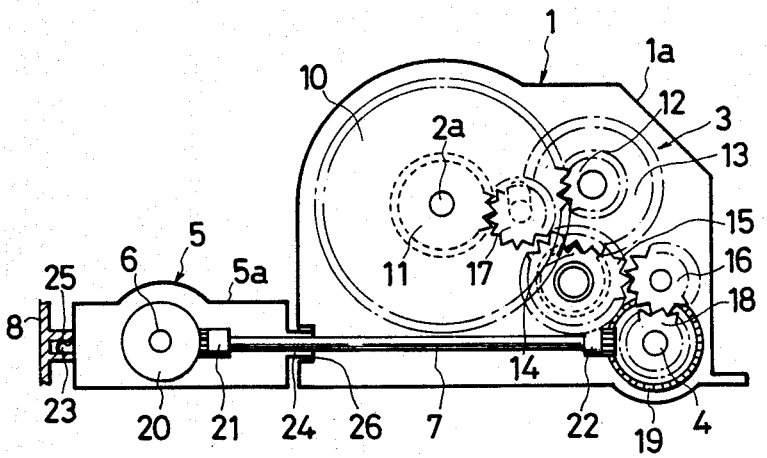
FIG. 3 is a schematic side view of the drive unit of FIG. 1.

When the toy vehicle A runs on a rough surface of a road and one of the front wheels 9 runs over a bumpy portion, as shown in FIG. 2, the gear mechanism 5 is pivoted around the axis of the link shaft 7, that is, the gear mechanism 5 is twisted with reference to the drive mechanism 1. At this time, the drive force is properly transmitted to the rear and the front axles 4 and 6 and thus to the four wheels 9 through the crown gears 19 and 20, the pinion gears 21 and 22 and the link shaft 7, and hence the drive force is properly transmitted from the four wheels 9 to the ground. When one of the rear wheels 9 runs over a bumpy portion, the situation is the same as the one described above. Thus the running of the four-wheel drive toy vehicle is obtained.

When it is desired that the gear ratios of the drive mechanism 1 and the gear mechanism 5 be changed, these may be readily removed and replaced by another combination of a drive mechanism and a gear mechanism or another four-wheel drive unit by a simple trouble-free (i.e. no lost components) operation.

It is readily understood from the above description that according to the present invention, a toy automobile including a four-wheel drive unit of the present invention can realize four-wheel drive running on a rough road when a front wheel axle is twisted in its axial rough road when reference to a rear wheel axle by rolling, and thus it can be used with much enjoyment. Further, in accordance with the present invention, the rear wheel axle drive mechanism and the front wheel axle gear mechanism are formed into units, and thus components, such as the windup spring, the gear wheels and so forth, will not come apart when the mechanisms are detached from the chassis. Thus the drive mechanism and the gear mechanism may be readily detached and a variety of interesting combinations of the drive mechanism and the gear mechanism may be enjoyed.

Although the present invention has been described and illustrated in its preferred embodiment thereof with reference to the accompanying drawings, however, it is readily understood that various changes and modifications may be made without departing from the spirit and scope of the present invention.

For instance, although in the preferred embodiment describe above, the gear mechanism 5 is pivotally mounted to the chassis 8, the drive mechanism 1 may be pivotally mounted to the chassis instead, in the same manner as the above described embodiment. In addition, the drive mechanism 1 and the gear mechanism 5 both may be pivotally mounted to the chassis 8 in the same manner as above.

The front wheel axle is driven by the drive mechanism and the rear wheel axle is included in the gear mechanism in another preferred embodiment. In this case, the front wheel axle is rotated in the reverse direction by adding one more intermediate gear wheel to the gear means, or the like.

What is claimed is:

1. A four-wheel drive unit for a toy vehicle comprising:

a spring drive mechanism;

a link shaft rotatably connected to the spring drive mechanism;

a gear mechanism rotatably connected to the link shaft; and means for rotating either the gear mechanism or the spring drive mechanism about the link shaft, the rotating means including a tubular projection and a support hole that provides an interface between the gear mechanism and spring drive mechanism, and further including a pivoting projection fixed to either the gear mechanism or the spring drive.

2. The invention of claim 1 wherein the spring drive mechanism includes a first casing, a windup spring, a first axle, a plurality of gear wheels, and a first link gear.

3. The invention of claim 2 wherein the gear mechanism includes a second casing, a second axle, and a second link gear.

4. The invention of claim 3 wherein the link shaft includes a pair of link gears which connects the first axle to the second axle.

5. The invention of claim 3 wherein either the first casing or second casing is provided with the tubular projection for supporting the link shaft and either the first casing or second casing is provided with the support hole in which the tubular projection is fitted.

6. A spring driven, four wheel drive unit for a mini toy vehicle having a chassis, comprising:

a windup drive mechanism including a first casing, a windup spring, a first axle, a plurality of gear wheels, and a first link gear;

a gear mechanism including second casing, a second axle, and a second link gear;

a link shaft extending along an axis and having a pair of link gears, the link shaft linking the first axle to the second axle; and means for rotating either the first casing or the second casing about the axis of the link shaft, the rotating means including a tubular projection and a first support hole that provides an interface between the first casing and the second support hole that provides an interface between the chassis and either the first casing or the second casing.

7. The invention of claim 6 wherein the windup spring is positioned within the first casing, the first axle is rotatably mounted to the first casing, and the first link gear is fixed to the first axle.

8. The invention of claim 7 wherein the second axle is rotatably mounted to the second casing and the second link gear is fixed to the second axle.

9. The invention of claim 6 wherein the link shaft is rotatably disposed in the tubular projection and the first support hole.

10. The invention of claim 9 wherein the pivoting projection and the second support hole are coaxial with the axis of the link shaft.

11. A four-wheel drive unit for a toy vehicle comprising:

a first casing;

a windup spring drive mechanism disposed therein;

a first axle rotatably mounted in the first casing and mechanically connected to the spring drive mechanism such that the drive force is transmitted to the firat axle;

a link shaft rotatably connected to the first axle and extending out of the first casing through a concentric tubular projection;

a second casing, on one end rotatably fitted about the tubular projection of the first casing and rotatably fitted to the toy vehicle on its opposite end;

a gear mechanism disposed within the second casing to which the link shaft is rotatably connected; and a second axle rotatably mounted in the second casing and rotatably connected to the gear mechanism.

* * * * *